US005187133A

United States Patent [19]

Yoshinari et al.

[11] Patent Number: 5,187,133

[45] Date of Patent: Feb. 16, 1993

[54] CATALYST COMPOSITION FOR HYDROTREATING OF HYDROCARBONS AND HYDROTREATING PROCESS USING THE SAME

[75] Inventors: Tomohiro Yoshinari, Urawa; Kazushi Usui, Noda; Yasuo Yamamoto, Koshigaya; Mitsuru Ohi, Souka, all of Japan

[73] Assignees: Cosmo Oil Co., Ltd.; Petroleum Energy Center, both of Tokyo, Japan

[21] Appl. No.: 670,719

[22] Filed: Mar. 18, 1991

[30] Foreign Application Priority Data

Mar. 30, 1990 [JP] Japan ..... 2-85967

[51] Int. Cl.[5] ..... B01J 29/06

[52] U.S. Cl. ..... 502/66

[58] Field of Search ..... 502/66

[56] References Cited

U.S. PATENT DOCUMENTS

| | | | |
|---|---|---|---|
| 3,622,501 | 11/1971 | Bertolacini et al. | 502/66 |
| 3,835,027 | 9/1974 | Ward | 502/66 |
| 4,568,655 | 2/1986 | Oleck et al. | 502/66 |
| 4,622,127 | 11/1986 | Noguchi et al. | 502/66 |
| 4,789,654 | 12/1988 | Hirano et al. | 502/66 |

FOREIGN PATENT DOCUMENTS

| | | |
|---|---|---|
| 0050911 | 5/1982 | European Pat. Off. . |
| 0216938 | 4/1987 | European Pat. Off. . |

*Primary Examiner*—Carl F. Dees

*Attorney, Agent, or Firm*—Oliff & Berridge

[57] ABSTRACT

A catalyst composition for the hydrotreatment of hydrocarbon oils is disclosed. The composition comprises at least one metal compound having hydrogenating activity belonging to a Group VIB or Group VIII carried on a carrier comprising 2–35% by weight of zeolite and 98–65% by weight of alumina or an alumina-containing substance, wherein, (A) said alumina or alumina-containing substance (1) has a mean pore diameter of 60–125 angstrom and (2) contains the pore volume of which the diameter falls within ±10 angstrom of the mean pore diameter of 70–98% of the total pore volume, (B) said zeolite (3) has a mean particle size of 6 μm or smaller and (4) contains particles of which the diameter is 6 μm or smaller of 70–98% of all zeolite particles. It has both high hydrodesulfurization and high cracking capabilities at the same time, and can selectively crack the heavy fractions which have once been hydrotreated, yielding lighter fractions.

22 Claims, No Drawings

CATALYST COMPOSITION FOR HYDROTREATING OF HYDROCARBONS AND HYDROTREATING PROCESS USING THE SAME

BACKGROUND OF THE INVENTION

1. Field of the Invention

The present invention relates to a catalyst composition used in a hydrotreatment of hydrocarbon oils, and, more particularly, to a highly active hydrotreatment catalyst composition comprising active metals carried in a well-dispersed manner on a carrier which comprises a mixture of zeolite with a specific particle size and a specific particle size distribution and alumina or an alumina-containing material having a specific pore distribution. The present invention also relates to a hydrotreatment process using such a catalyst.

2. Description of the Background Art

Heretofore, catalysts comprising one or more metals belonging to Group VIB or Group VIII of the Periodic Table carried on a refractory oxide carrier have been used for the hydrotreatment of hydrocarbon oils.

Cobalt-molybdenum or nickel-molybdenum catalysts carried on alumina carriers are typical examples of such hydrotreatment catalysts widely used in the industry. They can perform various functions such as desulfurization, denitrification, demetalization, deasphalting, hydrocracking, and the like depending on the intended purposes.

The characteristics demanded of such hydrotreating catalysts are a high activity and the capability of maintaining its activity for a long period of time.

In order to satisfy these requirements, firstly a large amount of active metals should be carried on carriers in a highly dispersed manner and, secondly, the catalyst should be protected from catalyst poisons such as metals, asphalten, sulfur- or nitrogen-containing macromolecular substances, and the like contained in the hydrocarbon oils.

A measure that has been proposed to achieve the above first object was to provide carriers having a larger specific surface area. A measure proposed to achieve the second object was to control the pore size distribution of the catalyst, i.e., either (i) to provide small size pores through which the catalyst poisons cannot pass or (ii) to provide large size pores with the carrier to increase the diffusibility of the catalytic poisons into the catalyst. These measures have been adopted in practice.

The recent trend of the difficult availability of lighter crude oils in spite of the increased demand of light fractions and high quality oil products increased the demand of hydrotreatment catalysts which have high desulfurization activities and at the same time hydrocracking or denitrification activities. The demand is vital especially in the hydrogenation process of residual oils containing asphalt.

The hydrocracking reaction generally proceeds slower than the hydrodesulfurization reaction, and since both reactions proceed in competition at the same active site, the relative activity ratio of the hydrodesulfurization to hydrocracking reactions remains almost constant in any reaction temperatures, e.g. in a relatively high severity operation purporting a hydrodesulfurization rate of 90%, the cracking rate remains almost constant at a certain level and cannot be increased.

In order to solve this problem a catalyst has been proposed in which acidic compounds, e.g. silica, titania, etc., are incorporated in an attempt of promoting the cracking activity by increasing the amount of acidic sites which can exhibit the cracking activity but not the hydrodesulfurization activity.

When the characteristics of a catalyst is considered, a smaller mean pore size which can provide a larger surface area is advantageous in order to achieve a greater dispersion of active metals throughout the catalyst. Small pores, however, are easily plugged by macromolecules, metallic components, and the like which are catalyst poisons. A larger pore size, on the other hand, has an advantage of accumulating metals deep inside the pores. Larger pores, however, provide only a small surface area, leading to insufficient dispersion of active metals throughout the catalyst. Thus, the determination of optimum pore size is very difficult from the aspect of the balance between the catalyst activity and the catalyst life.

As mentioned above, when a hydrotreatment involving the cracking reaction is intended, the addition of acidic compounds such as silica or titania is recommended. However, metal oxides which can form acidic sites when mixed with alumina generally exhibit smaller affinity for molybdenum than alumina. Because of this, the addition of a large amount of such acidic compounds lowers the dispersion of molybdenum throughout the catalyst, thus leading to a decreased desulfurization activity of the catalyst.

Furthermore, hydrocarbon oils having a wide boiling range or containing high molecular heavy components, e.g. atmospheric distillation residues (AR), are very difficult to be converted into lighter fractions by hydrocracking even by the addition of metal oxides which are capable of forming acidic sites.

Atmospheric distillation residues (AR) normally contain 50% or more of the fractions which constitute vacuum distillation residues (VR). Such fractions are subjected to the hydrocracking and acidic cracking reactions on molybdenum metal or on acidic sites and progressively are converted into light fractions. The cracking reactions, however, convert such heavy fractions into light gas oil (LGO) fractions with extreme difficulty, and can at most yield fractions equivalent to primary heavy gas oil (VGO) fractions. For example, vacuum distillation residue (VR) fractions can be cracked, for the most part, into a VGO equivalence, but cannot be cracked into lighter fractions. This means that the hydrocracked primary products, i.e. the products once subjected to a hydrocracking reaction, exhibit extremely low reactivity to a further cracking. Thus, it is very difficult to selectively obtain desired light fractions from heavy fractions by using conventional catalysts.

The subject to be solved by the present invention is, therefore, to develop a hydrotreatment catalyst having both high hydrodesulfurization and high cracking activities at the same time. More particularly, the subject involves, firstly, the determination of the optimum mean pore size and the optimum pore size distribution which are sufficient in ensuring high dispersion of active metals, and, secondly, the provision of a large number of acidic sites throughout the catalyst surface without impairing active metal dispersion, thus ensuring further selective hydrocracking of the heavy fractions which are the products of a previous hydrotreatment reaction. A further subject is to provide a hydrotreatment catalyst possessing a longer catalyst life and a higher activity, which ultimately contributes to promoting the economy of hydrocarbon oil processing.

SUMMARY OF THE INVENTION

The present inventors have undertaken extensive studies, and found that incorporating a specific amount of zeolite which is acidic and has a specific particle size and a specific particle size distribution into an alumina or alumina-containing carrier which has a specific mean pore diameter and a specific pore size distribution was effective in solving the above subjects. The present inventors have further found that the use of such a catalyst in the second or later reaction zone in a multi-stage reaction zone hydrotreatment process was effective to stably maintain the catalyst activity for a long period of time. These findings have led to the completion of the present invention.

Accordingly, an object of the present invention is to provide a catalyst composition for hydrotreating of hydrocarbon oils comprising at least one metal component having hydrogenating activity selected from the group consisting of metals belonging to Group VIB or Group VIII of the Periodic Table carried on a carrier comprising 2–35% by weight of zeolite and 98–65% by weight of alumina or an alumina-containing substance, and wherein, (A) said alumina or alumina-containing substance (1) has a mean pore diameter of 60–125 angstrom and (2) contains the pore volume of which the diameter falls within ±10 angstrom of the mean pore diameter in the range of 70–98% of the total pore volume, (B) said zeolite (3) has an average particle size of 6 μm or smaller and (4) contains particles of which the size is 6 μm or smaller in the range of 70–98% of all zeolite particles, and (C) said catalyst contains at least one metal belonging to Group VIB of the Periodic Table in an amount of 2–30% by weight (in terms of an oxide) and at least one metal belonging to Group VIII of the Periodic Table in an amount of 0.5–20% by weight (in terms of an oxide).

Another object of the present invention is to provide a multi-stage reaction zone hydrotreatment process of hydrocarbon oils characterized by using said catalyst composition in at least one reaction zone which is the second or later reaction zones.

Other objects, features and advantages of the invention will hereinafter become more readily apparent from the following description.

DETAILED DESCRIPTION OF THE INVENTION AND PREFERRED EMBODIMENTS

Either naturally occurring or synthesized zeolite can be used as a portion of the carrier of the catalyst composition of the present invention. Examples include faujasite X zeolite, faujasite Y zeolite (hereinafter referred to simply as Y zeolite), chabasite zeolite, mordenite zeolite, ZSM-series zeolite containing organic cation, e.g. ZSM-4, ZSM-5, ZSM-8, ZSM-11, ZSM-12, ZSM-20, ZSM-21, ZSM-23, ZSM-34, ZSM-35, ZSM-38, ZSM-43, etc., and the like. Particularly preferred are Y zeolite, stabilized Y zeolite, and ZSM-5. Furthermore, those containing silicon and aluminum at an atomic ratio (Si/Al) of 1 or more are preferable.

Preferable types of the cation of zeolite are ammonia and hydrogen. Those of which the ammonium or hydrogen is ion-exchanged with a poly-valency metal ion such as an alkaline earth metal ion, a rare earth metal ion, or a noble metal ion of Group VIII, e.g. magnesium, lanthanum, platinum, ruthenium, palladium, etc., for controlling the acidity of zeolite are desirable.

It is desirable that the content of alkali metal ions such as sodium ion in zeolite be about 0.5% by weight or smaller, since the presence of a great amount of an alkali metal ion decreases the catalyst activity.

Any known Y zeolites or stabilized Y zeolites can be used for the purpose of the present invention.

Y zeolites basically have the same crystal structure as that of natural faujasite, of which the chemical composition in terms of oxides is expressed by the formula $0.7\text{–}1.1R_{2/m}O.Al_2O_3.3\text{–}5SiO_2.7\text{–}9H_2O$, wherein R is Na, K, or other alkali metal ion or an alkaline earth metal ion, and m is the valence of the metal ion.

Stabilized Y zeolites disclosed by U.S. Pat. No. 3,293,192 and U.S. Pat. No. 3,402,996 are preferably used in the present invention. Stabilized Y zeolites, which are prepared by the repetition of a steam treatment of Y zeolites several times at a high temperature exhibit a remarkable improvement in the resistance against loss of the crystalinity. They have about 4% by weight or less, preferably 1% by weight or less, of $R_{2/m}O$ content and a unit lattice size of 24.5 angstrom. They are defined as the Y zeolites having a silicon to aluminum atomic ratio (Si/Al) of 3–7 or more.

Y zeolites and stabilized Y zeolites containing a large amount of alkali metal oxides or alkaline earth metal oxides are used after removal of these undesirable oxides of alkali metal or alkaline earth metal by ion-exchange.

Among ZSM-5 zeolites, those synthesized by the method described in U.S. Pat. No. 3,894,106, U.S. Pat. No. 3,894,107, U.S. Pat. No. 3,928,483, BP 1,402,981, or Japanese Patent Publication (ko-koku) No. 67522/1980 are preferably used.

These zeolites have a mean particle size of about 6 μm or smaller, preferably 5 μm or smaller, and more preferably 4.5 μm or smaller. Furthermore, the percentage of the particles having the size of about 6 μm or smaller is 70–98%, preferably 75–98%, and more preferably 80–98%, in the total zeolite particles. The differences between the moisture absorption capacity and the crystalinity of the zeolite and those of alumina are so great that they exhibit discrepancy in their contraction. Therefore, a large particle size of zeolite or its high content in the carrier results in the formation of relatively large mezo- or macropores in the carrier, when calcined by heating in the course of the preparation of the carrier. Such large pores not only lower the surface area of the catalyst but also allow metallic components which are the catalyst poisons to enter into and distribute inside the catalyst, especially when residual oils are treated, thus leading to decrease in the desulfurization, denitrification, and cracking activity of the catalyst.

In the present invention the particle size of zeolite is determined by electron microscope.

The amount of zeolite in the carriers is about 2–35% by weight, preferably 5–30% by weight, and more preferably 7–25% by weight. A too small content of zeolite leads to a decreased content of acid amount in the catalyst, and makes the dispersion of active metals throughout the catalyst inadequate. An excessive content of zeolite, on the other hand, results in an insufficient hydrodesulfurization activity of the catalyst.

One or more types of alumina, preferably gamma-alumina, chi-alumina, and eta-alumina, are used as a portion of the carrier. The alumina-containing substance in this invention is defined as the substance produced by mixing alumina and one or more refractory inorganic oxides other than alumina such as silica, magnesia, calcium oxide, zirconia, titania, boria, hafnia, and the like.

The alumina or alumina-containing substance has a mean pore diameter measured by the mercury method of 60–125 angstrom, preferably 65–110 angstrom, and more preferably 70–100 angstrom; and the pore volume of which the diameter falls within ±10 angstrom of said mean pore diameter is 70–98%, preferably 80–98%, and more preferably 85–98%, based on the total pore volume.

The reason that the foregoing mean pore diameter and the pore size distribution of alumina exhibit remarkable effects on the performance of the hydrotreatment of hydrocarbons, especially on the catalyst activity and the long life of the activity in the hydrodesulfurization is still to be elucidated. Too small pores would be plugged by catalyst poisons such as asphalt, resin, and metallic compounds when they adhere on the surface of the catalyst, thus completely shutting off the active sites of the catalyst. It can be presumed, however, that if a larger pores with a relatively sharp pore size distribution specified by the present invention are provided, the catalyst poisons attached to the surface of the catalyst do not completely plug the pores and allow the access of hydrocarbon molecules and sulfur compounds to the catalyst active sites, thus ensuring the catalyst to exhibit the high performance.

The amount of the alumina or alumina-containing substance in the carriers is about 65–98% by weight, preferably 70–95% by weight, and more preferably 75–93% by weight. A too small content of alumina in the carrier makes the molding of the catalyst difficult and decreases the desulfurization activity.

The total pore volume and the mean pore diameter of alumina or alumina-containing substances in the present invention are determined by a mercury porosimeter on the carrier as it contains zeolite. The pores of zeolite can be neglected. Since they are far smaller than those of alumina or alumina-containing substances, mercury cannot diffuse into them. Since it is impossible to measure the volumes of all pores which are actually present, the total pore volume of alumina or alumina-containing substances in the present invention represents the value determined from the mercury absorption amount at 4,225 $Kg/cm^2.G$ (60,000 psig) by the mercury porosimeter. The mean pore diameter of alumina or alumina-containing substances in the present invention is determined by the following method; i.e., first, the relationship between the pressure of the mercury porosimeter and the mercury absorption by the catalyst at 0–4,225 $Kg/cm^2.G$ is determined, and then the mean pore diameter is determined from the pressure at which the catalyst absorbs mercury one half of the amount that it absorbs at 4,225 $Kg/cm^2.G$ The mercury contact angle was taken as 130° and the surface tension presumed to be 470 dyne/cm. The relationship between the mercury porosimeter pressure and the pore size are known in the art.

The catalyst of the present invention can be prepared, for example, by the following method.

A dry gel of alumina or a dry alumina-containing substance are prepared (the first step).

Water soluble aluminum compounds are used as a raw material. Examples of water soluble aluminum compounds which can be used are water soluble acidic aluminum compounds and water soluble basic aluminum compounds, such as aluminum sulfate, aluminum chloride, aluminum nitrate, alkali metal aluminates, aluminum alkoxides, and other inorganic and organic aluminum salts. Water soluble metal compounds other than aluminum compounds can be added to the raw material solution. A typical example of preparing such a gel comprises providing an aqueous solution of an acidic aluminum compound solution (concentration: about 0.3–2 mol) and an alkaline solution of an aluminate and adding to this mixed solution an alkali hydroxide solution to adjust the pH to about 6.0–11.0, preferably to about 8.0–10.5, thus producing a hydrosol or hydrogel. Alternatively, aqueous ammonia, nitric acid, or acetic acid is added as appropriate to produce a suspension, which is then heated at about 50°–90° C. while adjusting the pH and maintained at this temperature for at least 2 hours. The precipitate thus obtained is collected by filtration and washed with ammonium carbonate and water to remove impuritie ions.

It is imperative in the preparation of the alumina gel that the hydrate of alumina or alumina-containing substance is produced while controlling the conditions such as temperature and the period of time during which the precipitate is produced and aged, such that the alumina or alumina-containing substance is provided with the mean pore diameter and the pore size distribution required for the hydrotreatment catalyst.

After washing, the precipitate is dried until no water is contained therein, thus obtaining a dry alumina gel or dry alumina-containing substance gel.

Zeolite is then prepared (the second step).

Commercially available zeolite or zeolite prepared according to a known method can be used as a raw material. Zeolite is used after ground, if the particle size is too large. Almost all known processes for the production of zeolite can be adopted for the purpose of the present invention, so long as such processes do not employ the inclusion of binders after the preparation.

Then, the alumina or alumina-containing substance from the first step and zeolite from the second step are mixed to obtain the carrier (the third step).

There are no specific limitations as to the method by which the alumina or alumina-containing substance and zeolite are mixed. Zeolite may be added in the course of the preparation of alumina or alumina-containing substance (Wet method), dried alumina or alumina-containing substance and zeolite powder are kneaded together (Dry method), or zeolite may be immersed into a solution of aluminum compound, followed by an addition of an appropriate amount of basic substance to effect precipitation of alumina or alumina-containing substance onto zeolite.

In the dry method, for example, the alumina or alumina-containing substance and zeolite are kneaded by a kneader. In this instance, the water content is adjusted such that the kneaded material can be molded, and then the material is molded into a desired shape by an extruder. The molding is carried out while controlling the molding pressure in order to ensure the desired mean pore diameter and pore size distribution. The molded product is dried at about 100°–140° C. for several hours, followed by calcination at about 200°–700° C. for several hours to obtain the carrier. At this point, the mean pore diameter and pore size distribution of the alumina or alumina-containing substance are measured.

Hydrogenating active metal components are then carried on the molded carrier thus produced (the fourth step).

There are no specific limitations as to the method by which hydrogenating active metal components are carried on the carrier. Various methods can be employed, including impregnation methods. Among impregnation methods, typical examples which can be given are the spray impregnation method comprising spraying a solution of hydrogenating active metal components onto carrier particles, the dipping impregnation method which involves a procedure of dipping the carrier into a comparatively large amount of impregnation solution, and the multi-stage impregnation method which consists of repeated contact of the carrier and impregnation solution.

When two or more active metal components are used, there are no restriction as to the order in which Group VIB metals and Group VIII metals are impregnated. They can be impregnated even simultaneously.

As Group VIB metals, one or more metals can be selected from chromium, molybdenum, tungsten, and the like. The use of molybdenum and tungsten, either individually or in combination, is preferable. A third metal can be added if desired.

As Group VIII metals, one or more metals selected from the group consisting of iron, cobalt, nickel, palladium, platinum, osmium, iridium, ruthenium, rhodium, and the like can be used. Cobalt and nickel are preferable Group VIII metals, and can be used either individually or in combination.

It is desirable that these Group VIB and Group VIII metals are carried onto the carrier as oxides or sulfates.

The amount of the active metals to be carried, in terms of the oxides in the total weight of the catalyst, is about 2-30% by weight preferably 7-25% by weight and more preferably 10-20% by weight, for Group VIB metals; and about 0.5-20% by weight, preferably 1-12% by weight, and more preferably 2-8% by weight, for Group VIII metals. If the amount of Group VIB metals is less than 2% by weight, a desired activity cannot be exhibited. The amount of Group VIB metals exceeding 30% by weight not only decreases the dispersibility of the metals but also depresses the promoting effect of Group VIII metals. If the amount of Group VIII metals is less than 0.5% by weight, a desired catalyst activity cannot be exhibited. The amount exceeding 20% by weight results in increased free hydrogenating active metals which are not combined with the carrier.

The resulting carrier on which hydrogenating active metal componetss are carried are then separated from the impregnation solution, washed with water, dried, and calcined. The same drying and calcination conditions as used in the preparation of the carrier are applicable for the drying and calcination of the catalyst.

The catalyst composition of the present invention usually possesses, in addition to the above characteristics, a specific surface area of about 200-400 $m^2/g$, the total pore volume of about 0.4-0.9 ml/g, a bulk density of about 0.5-1.0 g/ml, and a side crush strength of about 0.8-3.5 Kg/mm. It serves as an ideal catalyst for the hydrotreatment of hydrocarbon oils.

Table 1 summarizes the various characteristics of the catalyst composition of the present invention described above in detail.

TABLE 1

| | Wide range | Preferable range | Especially Preferable range |
|---|---|---|---|
| Zeolite | | | |
| Content (wt % in carrier) | 2-35 | 5-30 | 7-25 |
| Mean particle size (μm) | 6 or smaller | 5 or smaller | 4.5 or smaller |
| Proportion of particles with a 6 μm or smaller (wt % in zeolite) | 70-98 | 75-98 | 80-98 |
| Alumina or alumina-containing substance | | | |
| Content (wt % in carrier) | 98-65 | 95-70 | 93-75 |
| Mean pore size (angstrom) | 60-125 | 65-110 | 70-100 |
| Proportion of pores having a pore size of mean pore diameter ± 10 A (vol % for total alumina or alumina-containing substance) | 70-98 | 80-98 | 85-98 |
| Active metal components | | | |
| Group VIB metals (wt % in terms of oxide) | 2-30 | 7-25 | 10-20 |
| Group VIII metals (wt % in terms of oxide. in catalyst) | 0.5-20 | 1-12 | 2-8 |

The catalyst composition of the present invention exhibits very small deterioration in its activity, and can achieve a high desulfurization performance even under low-severity reaction conditions, especially under low pressure conditions.

Any type of reactors, a fixed bed, a fluidized bed, or a moving bed can be used for the hydrotreatment process using the catalyst composition of the present invention. From the aspect of simplicity of the equipment and operation procedures, use of fixed bed reactors is preferred.

In the hydrotreatment process using multi-stage reaction zones which are provided by the combination of two or more reactors, a high desulfurization performance can be achieved by using the catalyst composition of the present invention in the reaction zones in the second or later reactors. The operation giving a high rate of desulfurization and cracking to yield LGO or lower fractions can be maintained for a longer period of time by using pretreatment catalyst (first stage hydrotreatment catalyst) which mainly functions to remove metal components in the reaction zone of the former stage (the first stage) and using the catalyst composition of the present invention in the second and later reaction zones. The effect of such an arrangement is remarkable especially in the case of the hydrotreatment of heavy oils containing asphalt and the like.

Various types of hydrotreatment catalysts can be used as the first stage hydrotreatment catalyst depending on the type of the feed and the purpose of the hydrotreatment. For instance, a catalyst of the following composition is used for the purpose of demetalization of a feed containing a large amount of catalysts poisons, e.g. Arabian Light.

Kafuji, and Arabian Heavy atmospheric distillation residues.

| | |
|---|---|
| <Active metals> | |
| $MoO_3$ | 2-20% |
| NiO or CoO | 0.5-10% |
| <Pore diameter and pore diameter distribution> | |
| Mean pore diameter | 125-250 angstrom (or 65-125 angstrom when less than 70% is the mean pore diameter ±10 angstrom) |

A catalyst of the following composition is used for the purpose of denitrification of a feed.

| | |
|---|---|
| <Active metals> | |
| $MoO_3$ | 10-35% |
| NiO or CoO | 0.5-20% |
| $SiO_2$, $B_2O_3$, or $TiO_2$ | 2-30% |
| <Pore diameter> | |
| Mean pore diameter | 65-125 angstrom |

In practice, it is desirable to presulfurize the catalyst composition of the present invention before it is served for the hydrotreatment operation. The presulfurization can be carried out insitu in the reactor where the catalyst is used. In this instance, the catalyst composition of the present invention is contacted with sulfur-containing hydrocarbon oils, e.g. a sulfur-containing distillation fraction, at a temperature of about 150°-400° C., a pressure (total pressure) of about 15-150 Kg/cm$^2$, LHSV of about 0.3-80 Hr$^{-1}$, in the presence of about 50-1,500 l/l of hydrogen containing gas, following which the sulfur-containing fraction is switched to the raw feed and the operating conditions appropriate for the desulfurization of the raw feed is established, before initiating the normal operation.

An alternative method of the sulfur treatment of the catalyst composition of the present invention is to contact the catalyst directly with hydrogen sulfide or other sulfur compounds, or with a suitable hydrocarbon oil fraction to which hydrogen sulfide or other sulfur compounds are added.

Hydrocarbon oils, the feed of the hydrotreatment in the present invention, include light fractions from the atmospheric or vacuum distillation of crude oils, atmospheric or vacuum distillation residues, coker light gas oils, oil fractions obtained from the solvent deasphalting, tar sand oils, shale oils, coal liquefied oils, and the like.

The hydrotreatment conditions in the process of the present invention can be determined depending on the types of the raw feed oils, the intended desulfurization rate, the intended denitrification rate, and the like. Preferable conditions are usually about 320°-450° C., 15-200 Kg/cm$^2$.G, a feed/hydrogen-containing gas ratio of about 50-1,500 l/l, and LHSV of about 0.1-15 Hr$^{-1}$. A preferable hydrogen content in the hydrogen containing gas is about 60-100%.

Since in the catalyst composition of the present invention the carrier consists of zeolite and alumina or alumina-containing substance, silicon and oxygen atoms, being the major composite elements of zeolite, chemically bind with aluminum atoms on the alumina. Such chemical bonds provide additional acidic sites and ensure the promoted dispersion of hydrogenation active metal components throughout the catalyst.

In the hydrotreatment process of the present invention the catalyst composition is used in the reaction zones of the second or later reactors in the multi-stage reaction zones which are provided by the combination of two or more reactors. In this manner, high desulfurization and cracking performances can be achieved owing to the aforementioned high dispersion of active metal components throughout the catalyst.

Because of the shape selectivity of zeolite, the catalyst composition can again selectively crack the VGO fractions which are the product of the previous hydrocracking reaction of atmospheric or vacuum residue in the previous reaction zone (first reaction zone). More specifically, hydrocarbon oil molecules heavier than VGO fractions are too large to reach the acidic sites of zeolite in spite of their high reactivity, while the primary hydrotreatment products which have once been treated in the first reaction zone, although they have a lowered reactivity, can reach the acidic sites of zeolite and selectively utilize such acidic sites. As a result, the hydrotreatment process according to the present invention can produce light fractions such as LGO in a greater yield than in the conventional processes in which a catalyst using conventional carriers such as alumina or alumina-containing substances, e.g. silica-alumina, titania-alumina, are used without incorporating zeolite.

Since zeolite or silica is more hydrophobic than alumina, they have different hydration ratio (moisture absorption rate, water adsorption rate, etc.) and exhibit different rate of contraction during heating and calcining. Because of this, a number of problems are encountered in the conventional catalyst using an alumina-zeolite mixture as a carrier, such as formation of mezo- or macropores, cracks in the carrier particles, and the like. In order to minimize the contraction difference between alumina and zeolite as small as possible and to minimize the formation of mezo- or macropores during the calcination, various limitations are imposed on the incorporation of zeolite in the present invention, including the amount, the particle size, and the like. Specifically, the particle size is limited to 6 μm or smaller and the particles having the sizes of 6 μm and smaller must be present in an amount of 70-98%. This ensures the increase in the amount of zeolite to be incorporated in the carrier, the promoted dispersibility of zeolite throughout the carrier, and the increased acidic sites due to the chemical bonds between silicon or oxygen atom of zeolite and aluminum atom of alumina.

Furthermore, by the use of alumina or alumina-containing substance having a mean pore diameter of 60-125 angstrom and a sharp pore size distribution, i.e., by providing the pore volume of which the diameter falls within ±10 angstrom of the mean pore diameter in an amount of 70-98% of the total pore volume, the catalyst composition effectively prevents the catalyst poisons such as asphalt, resin, metallic compounds attached to the surface of the catalyst from clogging the pores, thus allowing the access of the hydrocarbon molecules and sulfur-containing compounds to the active sites of the catalyst, which ensures the high performance of the catalyst composition.

Thus, the catalyst composition of the present invention is capable of promoting both the desulfurization activity and the cracking activity to a great extent, and the process of the present invention is a very advantageous hydrotreatment process of hydrocarbon oils fully utilizing the favorable features of the catalyst composition.

In the present invention, the term "hydrotreatment" means the treatment of hydrocarbon oils effected by the contact of hydrocarbon oils with hydrogen, and includes refining of hydrocarbon oils by hydrogenation under comparatively low severity conditions, refining by hydrogenation under comparatively high severity conditions which involve some degree of cracking, hydroisomerization, hydrodealkylation, and other reactions of hydrocarbon oils in the presence of hydrogen. More specifically, it includes hydrodesulfurization, hydrodenitrification, and hydrocracking of atmospheric or vacuum distillation fractions and residues, hydrotreatment of kerosene fractions, gas oil fractions, waxes, and lube oil fractions.

As fully illustrated above, the catalyst composition of the present invention using a carrier mixture comprising zeolite with a specific particle size and alumina or an alumina-containing substance having a specific pore size distribution at a specific ratio can exhibit both the excellent desulfurization and cracking activities and can maintain these excellent activities for a long period of time.

Furthermore, the use of this catalyst composition in the second or later reaction zones in a multi-stage hydrotreatment reaction process allows a greater content of catalyst poisons in the hydrocarbon oil feedstocks and permits the primary hydrotreatment product which have previously been treated in the first reaction zone to be again hydrotreated at a high efficiency. These features very favorably accommodate the recent requirements of the high quality, lighter fraction oil products against the ever continuing trend of unavailability of light crude oil.

Other features of the invention will become apparent in the course of the following description of the exemplary embodiments which are given for illustration of the invention and are not intended to be limiting thereof.

EXAMPLES

In Examples 1-8 and Comparative Examples 1-3 below the relative activities of the catalysts with respect to hydrodesulfurization and hydrocracking were evaluated according to the following method. The results are presented in each example.

Test method for the evaluation of relative hydrodesulfurization and hydrocracking activities Catalysts A-H (Examples) and Catalysts Q-S (Comparative Examples) were subjected to the treatment of Arabian Heavy fuel oil (AH-DDSP), a product from Arabian Heavy atmospheric residue by a direct desulfurization process, in a fixed bed reaction tube having an internal diameter of 14 mmϕ. The relative activities (the relative hydrodesulfurization activity and the relative hydrocracking activity) of the catalysts were evaluated based on the desulfurization rate (%) and the cracking rate (%), respectively. The relative hydrodesulfurization activity was determined from the residual sulfur content (wt %) of the reaction product obtained on the 25th day after the commencement of the reaction (the sulfur content of the product is small at the initial stage of the reaction but increases as the reaction proceeds).

The cracking rate was determined from the decrease in the amount of the fractions boiling higher than the prescribed temperature (343° C.+) in the product according to the following equation.

$$\text{Cracking rate of the atmospheric residue (wt \%)} = \frac{(343^\circ\ C.^+ \text{ fractions in the feed}) - (343^\circ\ C.^+ \text{ fractions in the product})}{(343^\circ\ C.^+ \text{ fractions in the feed})} \times 100$$

The properties of the feed oil and the reaction conditions are summarized below.

| | |
|---|---|
| Arabian Heavy fuel oil (a product of a direct desulfurization process; AH-DDSP) | |
| Sulfur (wt %) | 0.62 |
| Nitrogen (wt %) | 0.15 |
| Ni (ppm) | 12 |
| V (ppm) | 16 |
| Reaction conditions | |
| Temperature (°C.) | 400 |
| Pressure ($Kg/cm^2 \cdot G$) | 145 |
| LHSV ($Hr^{-1}$) | 0.2 |

Example 1 (Preparation of Catalyst A)

First Step (Preparation of dry alumina gel)

6.4 l of ion-exchanged water was charged into a 20 l plastic container, followed by an addition of 1.89 Kg of an aqueous solution of sodium aluminate (containing 17.4% of $Na_2O$ and 22% of $Al_2O_3$), to obtain 8.29 Kg of a solution containing 5% of $Al_2O_3$. To the solution were added 21 g of 50% aqueous solution of gluconic acid while stirring, and then rapidly 8.4% aqueous solution of aluminum sulfate until the solution became pH 9.5. The amount of aluminum sulfate solution added was about 8.3 Kg. All these procedures were carried out at room temperature. A white slurry thus obtained was allowed to stand still overnight for aging, dehydrated by Nutsche, and washed with a 5-fold amount of 0.2% aqueous ammonia to obtain an alumina hydrate cake containing 7.5-8% of $Al_2O_3$ and, as impurities, 0.001% of $Na_2O$ and 0.00% of $SO_4^{-2}$.

Second Step (Preparation of Y zeolite)

A commercially available Y zeolite, SK-41 Na-type (trademark, a product of Linde Corp., U.S.A.) was used. The Y zeolite was ground to adjust the particle size such that the average particle size was 2.5 μm and the content of particles with 6 μm or smaller diameter was about 85% of the total zeolite.

Third Step (Preparation of the carrier)

The crystalline Y zeolite obtained in the second step was mixed with the product of the first step in such a proportion that the amount of zeolite (in dry basis) in the carrier be 10% by weight. The mixture was thoroughly kneaded with an kneader while drying to adjust its water content appropriate for the molding. Then, the kneaded product was molded with an extruder to obtain cylindrical pellets with a diameter of 1/16". The extrusion was performed by controlling the molding pressure so as to obtain the desired mean pore diameter and pore distribution. The pellets were dried at 120° C. for 3 hours and calcined a 450° C. for 3 hours to produce the carrier.

Fourth Step (Inclusion of metals)

An aqueous solution of a molybdenum compound $[(NH_4)_6Mo_7O_{24}.4H_2O)]$ in an amount of 15% by weight, as molybdenum oxide, was impregnated in the carrier prepared in the third step, followed by drying the resulting carrier at 120° C. in the air and calcination at 450° C. The product was then immersed into an aqueous solution of a nickel compound $[Ni(NO_3)_3.6H_2O)]$ in an amount of 5% by weight, as nickel oxide, dried at 120° C. in the air, and heated to 350° C. at a rate of 10° C./min, from 350°-600° C. at a rate of 5° C./min, then calcined at 600° C. for about 4 hours to obtain Catalyst A.

Examples 2-4 (Preparation of Catalyst B-D)

Catalyst B was prepared in the same manner as in Example 1, except that the amount (in dry basis) of Y zeolite added in the third step was 20% by weight (Example 2).

Catalyst C (Example 3) and Catalyst D (Example 4) were prepared in the same manner as in Example 1, except that Y zeolite having an average particle size of 1.7 μm (Catalyst C) or 3.9 μm (Catalyst D) were used in the third step.

Compositions and the results of the evaluation of relative desulfurization and cracking activities on Catalysts A, B, C, and D are shown in Table 2.

TABLE 2

| Catalyst | A | B | C | D |
|---|---|---|---|---|
| Alumina | | | | |
| Content (wt % in carrier) | 90 | 80 | 90 | 90 |
| Mean pore diameter (angstrom) | 85 | 85 | 86 | 85 |
| Proportion of pores having a pore size of mean pore diameter ± 10 A (vol % in alumina) | 88 | 87 | 88 | 88 |
| Y zeolite | | | | |
| Content (wt % in carrier) | 10 | 20 | 10 | 10 |
| Mean particle diameter (μm) | 2.5 | 2.5 | 1.7 | 3.9 |
| Proportion of particles with a 6 μm or smaller diameter (wt % in zeolite) | 85 | 86 | 91 | 92 |
| NiO content (wt % in catalyst) | 5 | 5 | 5 | 5 |
| $MoO_3$ content (wt % in catalyst) | 15 | 15 | 15 | 15 |
| Desulfurization rate (%) | 93 | 90 | 90 | 91 |
| AR Cracking rate (%) | 21 | 20 | 19 | 20 |

Example 5 (Preparation of Catalyst E)

First Step (Preparation of dry alumina-containing gel)

An aqueous solution of sodium hydroxide (NaOH: 278 g, distilled water: 2 l) and an aqueous solution of aluminum sulfate (aluminum sulfate: 396 g, distilled water: 1 l) were added to 2 l of distilled water at room temperature, followed by the adjustment of pH to 8.5-9.2 by the addition of an aqueous solution of sodium hydroxide or an aqueous solution of nitric acid. The mixture was heated to 85° C. and allowed to stand still for aging for about 5 hours.

After the addition of an aqueous solution of sodium silicate [No. 3 water glass ($SiO_2$ 35-38%, $Na_2O$ 17-19%): 35.5 g, distilled water: 500 g] while adjusting the pH to about 8.5 with the addition of an aqueous solution of nitric acid, the mixture was allowed to stand still for aging at 85° C. for about 5 hours.

The slurry thus obtained was filtered to collect the precipitate, which was again made into a slurry with an addition of 2.0% ammonium carbonate solution, followed by filtration again. The procedure of washing with the ammonium carbonate solution and filtration was repeated until the sodium concentration of the filtrate became as low as 6 ppm, after which the precipitate was dried by dehydration by a pressure filter, thus obtaining a gel cake in which silica gel was precipitated in alumina gel particles.

Catalyst E was prepared by using the above gel cake according to the same procedures as in the second, third, and fourth steps of Example 1.

Examples 6 and 7 (Preparation of Catalysts F, G)

Catalysts F and G were prepared in the same manner as in Example 5 (First step) and Example 1 (subsequent steps), except that for the preparation of gel cakes 31.1 g of $TiCl_4$ (Catalyst F) and 13.1 g of sodium borate (Catalyst G) were used instead of water glass in Example 5, and an aqueous solution of cobalt nitrate was used instead of the aqueous solution of nickel nitrate in the fourth step of Example 1.

Example 8 (Preparation of Catalyst H)

A carrier was prepared following the procedures of the first step of Example 5 and the second and third step of Example 1.

Fourth Step (Inclusion of metals)

An aqueous solution of a molybdic ammonium in an amount of 15% by weight, as molybdenum oxide, was impregnated in the carrier, followed by drying the resulting carrier at 120° C. in the air and calcination at 450° C. The product was then immersed into a mixed aqueous solution of nickel nitrate and cobalt nitrate in an amount of 2.5% by weight, as oxides, dried at 120° C. in the air, and heated to 350° C. at a rate of 10° C./min, from 350°-600° C. at a rate of 5° C./min, then calcined at 600° C. for about 4 hours to obtain Catalyst H.

Compositions and the results of the evaluation of relative desulfurization and cracking activities of Catalysts E, F, G, and H are shown in Table 3.

TABLE 2

| Catalyst | E | F | G | H |
|---|---|---|---|---|
| Alumina content (wt % in carrier) | 80 | 80 | 80 | 80 |
| Silica content (wt % in carrier) | 10 | — | — | 10 |
| Titania content (wt % in carrier) | — | 10 | — | — |
| Boria content (wt % in carrier) | — | — | 10 | — |
| Mean pore diameter (angstrom) | 88 | 85 | 86 | 88 |
| Proportion of pores having a pore size of mean pore diameter ± 10 A (vol % in alumina-containing substance) | 90 | 87 | 89 | 90 |
| Y zeolite | | | | |
| Content | 10 | 10 | 10 | 10 |

TABLE 2-continued

| Catalyst | E | F | G | H |
|---|---|---|---|---|
| (wt % in carrier) | | | | |
| Mean particle diameter (μm) | 2.5 | 2.5 | 2.5 | 2.5 |
| Proportion of particles with a 6 μm or smaller diameter (wt % in zeolite) | 85 | 86 | 85 | 86 |
| NiO content (wt % in catalyst) | 5 | — | — | 2.5 |
| CoO content (wt % in catalyst) | — | 5 | 5 | 2.5 |
| $MoO_3$ content (wt % in catalyst) | 15 | 15 | 15 | 15 |
| Desulfurization rate (%) | 92 | 89 | 90 | 87 |
| AR Cracking rate (%) | 19 | 19 | 18 | 21 |

Comparative Example 1 (Preparation Catalyst Q)

Catalyst Q represents the catalyst prepared using alumina produced in the first step of Example 1 as a carrier. The active metals were carried on the carrier by the same method as the fourth step in Example 1.

Comparative Example 2 (Preparation Catalyst R)

Catalyst R was prepared by the same method as Example 1, except that in the third step Y zeolite was incorporated in an amount of 40% by weight of the carrier on the dry basis.

Comparative Example 3 (Preparation Catalyst S)

Catalyst S was prepared in the same manner as in Example 1, except that in the second step Y zeolite was ground so as to adjust the average particle size to 9.0 μm and the content of particles with 6 μm or smaller particle size to about 60% of the total zeolite.

Compositions and the results of the evaluation of relative desulfurization and cracking activities on Catalysts Q, R, and S are shown in Table 4.

TABLE 4

| Catalyst | Q | R | S |
|---|---|---|---|
| Alumina | | | |
| Content (wt % in carrier) | 100 | 60 | 90 |
| Mean pore diameter (angstrom) | 85 | 85 | 86 |
| Proportion of pores having a pore size of mean pore diameter ± 10 A (vol % in alumina) | 88 | 87 | 88 |
| Y zeolite | | | |
| Content (wt % in carrier) | — | 40 | 10 |
| Mean particle size (μm) | — | 2.5 | 9.0 |
| Proportion of particles with a 6 μm or smaller diameter (wt % in zeolite) | — | 86 | 60 |
| NiO content (wt % in catalyst) | 5 | 5 | 5 |
| $MoO_3$ content (wt % in catalyst) | 15 | 15 | 15 |
| Desulfurization rate (%) | 86 | 60 | 73 |
| AR Cracking rate (%) | 13 | 15 | 12 |

In the Examples 9–14 below the relative activities of the catalysts with respect to hydrodesulfurization and hydrodenitrification were evaluated according to the following method and compared with Catalyst Q prepared in Comparative Example 1. The results are presented in each example.

Test method for the evaluation of relative hydrodesulfurization and hydrodenitrification activities Catalysts I–N (Examples) and Catalysts Q (Comparative Example), were used for the treatment of Arabian Light vacuum gas oil (AL-VGO) in a fixed bed reaction tube having an internal diameter of 14 mmϕ. The relative activities (the relative hydrodesulfurization activity and the relative hydrodenitrification activity) of the catalyst were evaluated based on the desulfurization rate (%) and the denitrification rate (%), respectively, which were determined from the residual sulfur content (wt %) and the residual nitrogen content (wt %) of the reaction product obtained on the 25th day after the commencement of the reaction (the sulfur content is small at the initial stage of the reaction but increases as the reaction proceeds). The properties of the feed oil and the reaction conditions are summarized below.

| | |
|---|---|
| Arabian Light vacuum gas oil (AL-VGO) | |
| Sulfur (wt %) | 2.45 |
| Nitrogen (wt %) | 0.084 |
| Reaction conditions | |
| Temperature (°C.) | 350 |
| Pressure ($Kg/cm^2 \cdot G$) | 50 |
| LHSV ($Hr^{-1}$) | 0.4 |

Example 9 (Preparation of Catalyst I)

The same procedures as in the first, third, and fourth steps of Example 1 were followed for the preparation of Catalyst I.

The second steps; the preparation of ion-exchanged zeolite was carried out as follows:

A commercially available Y zeolite, SK-41 Na-type (trademark, a product of Linde Corp., U.S.A.) was used. The ion-exchange was performed by first converting the zeolite into $NH_4$-type and then replacing $NH_4$ with a metal ion. For the preparation of $NH_4$-type Y zeolite, 150 g of the commercially available Na-Y zeolite was placed in a 1,000 ml conical flask. About 750 ml of 1N aqueous solution of $NH_4Cl$ was then added to it and stirred at 70° C. for 3 hours. Then the ion-exchange liquid was discharged by decantation and replaced with a fresh ion-exchange liquid. This procedure for replacing the ion-exchange liquid was repeated 6 times in total. Lastly, the zeolite was thoroughly washed, filtered, and dried to obtain $NH_4$-type Y zeolite (Step A).

150 g of $NH_4$-type Y zeolite was placed in a 1,000 ml conical flask, followed by an addition of about 750 ml of a 1N cation solution (1N $LaCl_3$). The conical flask was placed in a thermostat bath equipped with a reflux condenser and kept at a temperature of 70° C. Then the ion-exchange liquid was discharged by decantation and replaced with a fresh ion-exchange liquid. This procedure for replacing the ion-exchange liquid was carried out 10 times in total. Lastly, the zeolite was thoroughly washed, filtered, and dried to obtain La-ion-exchanged Y zeolite, with an La-ion exchange rate of 76.1% (Step B).

Examples 10–14 (Preparation of Catalysts J–N)

Catalysts J, K and L were prepared in the same manner as in Example 9, except that instead of the 1N $LaCl_3$ solution aqueous solutions of 0.01N $[Pt(NH_3)_4]Cl_2$ (Example 10: Catalyst J), 0.015N $[Ru(NH_3)_6]Cl_3$ (Example 11: Catalyst K), or 0.01N $[Pd(NH_3)_4]Cl_2$ (Example 12: Catalyst L) was used. The ion exchange rates were 72.6% for Catalyst J, 63.1% for Catalyst K, and 66.8% for Catalyst L.

Catalysts M and N were prepared in the same manner as in Example 1, except that instead of Y zeolite ZSM-5

(Example 13: Catalyst M) or mordenite (Example 14: Catalyst N) was used in the third step.

Compositions and the results of the evaluation of relative desulfurization and denitrification activities on Catalysts J–N and Catalyst Q, as well as those of Catalyst A, are shown in Table 5.

TABLE 5

| Catalyst | A | I | J | K | L | M | N | Q |
|---|---|---|---|---|---|---|---|---|
| Alumina | | | | | | | | |
| Content (wt % in carrier) | 90 | 90 | 90 | 90 | 90 | 90 | 90 | 100 |
| Mean pore diameter (angstrom) | 85 | 85 | 85 | 86 | 85 | 85 | 86 | 85 |
| Proportion of pores having a pore size of "mean pore diameter ± 10 A" (vol % in alumina) | 88 | 87 | 88 | 88 | 88 | 88 | 88 | 88 |
| Zeolite Content (wt % in carrier) | | | | | | | | |
| Y-zeolite | 10 | — | — | — | — | — | — | — |
| La-zeolite | — | 10 | — | — | — | — | — | — |
| Pt-zeolite | — | — | 10 | — | — | — | — | — |
| Ru-zeolite | — | — | — | 10 | — | — | — | — |
| Pd-zeolite | — | — | — | — | 10 | — | — | — |
| ZSM-5 | — | — | — | — | — | 10 | — | — |
| Mordenite | — | — | — | — | — | — | 10 | — |
| Zeolite | | | | | | | | |
| Mean particle size (μm) | 2.5 | 2.5 | 2.5 | 2.5 | 2.5 | 2.5 | 2.5 | — |
| Proportion of particles with a 6 μm or smaller diameter (wt % in zeolite) | 85 | 86 | 86 | 85 | 90 | 89 | 88 | — |
| NiO content (wt % in catalyst) | 5 | 5 | 5 | 5 | 5 | 5 | 5 | 5 |
| $MoO_3$ content (wt % in catalyst) | 15 | 15 | 15 | 15 | 15 | 15 | 15 | 15 |
| Desulfurization rate (%) | 83 | 85 | 83 | 85 | 82 | 83 | 83 | 81 |
| Denitrification rate (%) | 66 | 69 | 72 | 75 | 73 | 77 | 66 | 60 |

As can be seen from Tables 2–5, Catalyst A (Example 1) of the present invention exhibited higher desulfurization and cracking activities, as well as a higher denitrification activity, than Catalyst Q (Comparative Example 1) in which no zeolite was incorporated.

Furthermore, the effects of incorporation of zeolite on these catalyst activities were demonstrated to be more remarkable in the treatment of vacuum gas oil than the fuel oil which had previously been subjected to a direct desulfurization treatment.

Catalyst I–L, in which Na-ion in Y zeolite was replaced by other metal ions, exhibited the enhanced effect of inclusion of zeolite in carriers. The same effects were realized in Catalysts M and N (Examples 13 and 14) to which ZSM or mordenite was incorporated instead of Y zeolite. Especially Catalyst M exhibited an excellent denitrification activity.

In Examples 15 and 16 and Comparative Examples 4–6 hereinafter the relative activities of the catalysts with respect to the hydrodesulfurization and the resistance against accumulation of metals were evaluated according to the following methods. The results are presented in each example.

Test method for the evaluation of relative hydrodesulfurization activity

Catalysts O and P (Examples) and Catalysts T, U, V (Comparative Examples), were used for the treatment of Arabian Heavy atmospheric residue (AH-AR) in a fixed bed reaction tube having an internal diameter of 14 mmϕ. The relative hydrodesulfurization activity of the catalysts was evaluated based on the desulfurization rate (%), which were determined from the residual sulfur content (wt %) of the reaction product obtained on the 20th day after the commencement of the reaction (the sulfur content is small at the initial stage of the reaction but increases as the reaction proceeds). The properties of the feed oil and the reaction conditions are summarized below.

| | |
|---|---|
| Arabian Heavy atmospheric residue (AH-AR) | |
| Sulfur (wt %) | 4.3 |
| Ni (ppm) | 30 |
| V (ppm) | 96 |
| Reaction conditions | |
| Temperature (°C.) | 390 |
| Pressure (Kg/cm$^2$ · G) | 105 |
| LHSV (Hr$^{-1}$) | 1.0 |

Durability test method on metal accumulation

The resistance of catalysts against the metal accumulation was evaluated using a heavy oil having an ultra-high metal content as a feed oil, instead of Arabian Heavy AR. The amount of metals accumulated on the catalyst during the operation until the desulfurization rate decreased to 20% was taken as the measure of resistance capability of the catalyst against the metal accumulation (the minimum metal allowability). The properties of the feed oil and the reaction conditions were as follows.

| | |
|---|---|
| Boscan crude oil | |
| Specific gravity (15/4° C.) | 0.9994 |
| Sulfur (wt %) | 4.91 |
| Nitrogen (wt %) | 0.57 |
| Viscosity (cSt at 50°) | 5,315 |
| Pour point (°C.) | +10.0 |
| Ni (ppm) | 110 |
| V (ppm) | 1,200 |
| Carbon residue (wt %) | 16.4 |
| Asphaltene (wt %) | 12.9 |
| Reaction conditions | |
| Temperature (°C.) | 395 |
| Pressure (Kg/cm$^2$ · G) | 105 |
| LHSV (Hr$^{-1}$) | 0.5 |
| $H_2$/Oil ratio (Nm$^3$/Kl) | 1,780 |

Examples 15 and 16 (Preparation of Catalyst O and P)

Catalysts O (Example 15) and P (Example 16) were prepared according to the procedures of Example 1, except that the molding pressures in the third step were adjusted so as to obtain alumina with a mean pore diameter of 95 angstrom (Catalyst O) and 75 angstrom (Catalyst P) and, in the fourth step, an aqueous solution of molybdenum compound $[(NH_4)_6Mo_7O_{24}.4H_2O]$ and nickel compound $[Ni(NO_3)_3.6H_2O]$ was impregnated so as to incorporate molybdenum and nickel in the amounts of 12% by weight and 4.0% by weight, in terms of oxides respectively, for both Catalyst O and Catalyst P.

Comparative Examples 4-6 (Preparation of Ctalysts T-V)

Catlysts T (Comparative Example 4), Catlysts U (Comparative Example 5), and Catlysts V (Comparative Example 6) were prepared according to the procedures of Example 1, except that the aging period in the first step and the molding pressures in the third step were adjusted so as to obtain alumina with the following mean pore diameter (angstrom) and the following proportion (vol % in alumina) of pores having a pore size of "mean pore size ±10 angstrome":

Catalyst T: 60 angstrom and 90%
Catalyst U: 140 angstrom and 80%
Catalyst V: 85 angstrom and 60% and further that, in the fourth step, an aqueous solution of molybdenum compound $[(NH_4)_6Mo_7O_{24}.4H_2O]$ and nickel compound $[Ni(NO_3)_3.6H_2O]$ was impregnated so as to incorporate molybdenum and nickel in the amounts of 12% by weight and 4.0% by weight, as oxides, respectively, for all Catalysts T, U, and V.

Compositions and the results of the evaluation of the relative desulfurization and the maximum metal allowability of Catalysts O, P, T, U, and V are shown in Table 6.

TABLE 6

| Catalyst | O | P | T | U | V |
|---|---|---|---|---|---|
| Alumina | | | | | |
| Content (wt % in carrier) | 90 | 90 | 90 | 90 | 90 |
| Mean pore diameter (angstrom) | 95 | 75 | 55 | 140 | 85 |
| Proportion of pores having a pore size of "mean pore diameter ± 10 A" (vol % in alumina) | 88 | 87 | 90 | 86 | 60 |
| Y zeolite | | | | | |
| Content (wt % in carrier) | 10 | 10 | 10 | 10 | 10 |
| Mean particle size (μm) | 2.5 | 2.5 | 2.5 | 2.5 | 2.5 |
| Proportion of particles with a 6 μm or smaller diameter (wt % in zeolite) | 85 | 86 | 85 | 86 | 86 |
| NiO content (wt % in catalyst) | 4 | 4 | 4 | 4 | 4 |
| $MoO_3$ content (wt % in catalyst) | 12 | 12 | 12 | 12 | 12 |
| Desulfurization rate (%) | 72 | 79 | 70 | 61 | 63 |
| Accumulated metal content (g/100 ml catalyst) | 18 | 12 | 8 | 23 | 17 |

As can be seen fron Table 6, Catalysts O and P of Examples 15 and 16 of the present invention which have the specified mean pore diameter and pore size distribution could maintain a high desulfurization activity without decreasing the maximum metal allowablility; i.e., without decreasing their catalyst life. In contrast, Catalyst T of Comparative Example 4 having too small pore diameter exhibited a great decrease in the maximum metal allowability, and Catalyst U of Comparative Example 5 which has too large pore diameter in spite of its sharp pore size distribution or Catalyst V of Comparative Example 6 which has a suitable pore diameter but a broad pore size distribution exhibited very poor desulfurization performance.

Example 17 and Comparative Example 8-9

The relative catalyst life tests (Example 17 and Comparative Example 8-9) of hydrodesulfurization were carried out using Arabian Light atmospheric residue (AL-AR) as a feedstock in a two-satge hydrotreatment process. In Example 17 and Comparative Examples 8-9, the primary hydrotreatment catalyst (X) having characteristics shown in Table 7 was used for the first stage treatment, and, for the second stage treatment, Catalyst A prepared in Example 1 (Example 17), Catalyst Q prepared in Comparative Example 1 (Comparative Example 8), and Catalyst W prepared in Comparative Example 7, of which the characteristics are given in Table 7, (Comparative Example 9) were used. The ratio in volume of the catalysts used in the first and second stages was 30:70.

The tests were carried out under the following reaction conditions.

| Reaction temperature (°C.) The temperature required to produce the product oil with a sulfur content of 0.3% by weight. | |
|---|---|
| Reaction pressure ($Kg/cm^2 \cdot G$) | 105 |
| LHSV ($Hr^{-1}$) | 0.25 |

Changes in the reaction temperature over time required by the test are shown in FIG. 1, in which the Curves 1, 2, and 3 represent the results obtained by Example 17, Comparative Example 8, and Comparative Example 9, respectively. The properties of the product oils which were obtained when the reaction temperature was 385° C. are given in Table 8.

TABLE 7

| | Catylyst W | Primary hydro-treatment catalyst |
|---|---|---|
| Alumina content (wt % in carrier) | 80 | 100 |
| Silica content (wt % in carrier) | 20 | — |
| Mean pore diameter (angstrom) | 82 | 100 |
| Proportion of pores having a pore size of "mean pore diameter ± 10 A" (vol % in alumina-containing substance) | 88 | — |
| NiO content (wt % in catalyst) | 5 | 4 |
| $MoO_3$ content (wt % in catalyst) | 15 | 12 |

TABLE 8

| | Feed (wt %) | Product Oil (wt %) | | |
|---|---|---|---|---|
| The second stage catalyst | | A | Q | |
| Feed/Product oil (b.p. range) | | | | |
| LGO fraction (below 343° C.) | — | 34 | 19 | 14 |
| VGO fraction (343-566° C.) | 50 | 36 | 50 | 51 |
| VR fraction (above 566° C.) | 50 | 30 | 31 | 35 |
| Days operated before the reaction temperature | | 220 | 150 | 130 |

TABLE 8-continued

| | Feed (wt %) Product Oil (wt %) | |
|---|---|---|
| The second stage catalyst | A | Q |
| reached 385° C. | | |

Obviously, numerous modifications and variations of the present invention are possible in light of the above teachings. It is therefore to be understood that within the scope of the appended claims, the invention may be practiced otherwise than as specifically described herein.

What is claimed is:

1. A catalyst composition for the hydrotreatment of hydrocarbon oils comprising at least one metal component having hydrogenating activity selected from the group consisting of metals belonging to Group VIB or Group VIII of the Periodic Table carried on a carrier comprising 2–35% by weight of zeolite and 98–65% by weight of alumina or an alumina-containing substance, and wherein, (A) said alumina or alumina-containing substance (1) has a mean pore diameter of 60–125 angstrom and (2) contains the pore volume of which the diameter falls within ±10 angstrom of the mean pore diameter of 70–98% of the total pore volume, (B) said zeolite (3) has an average particle size of 6 μm or smaller and (4) contains particles of which the diameter is 6 μm or smaller of 70–98% of all zeolite particles, and (C) said catalyst contains at least one metal belonging to Group VIB of the Periodic Table in an amount of 2–30% by weight, in terms of an oxide, and at least one metal belonging to Group VIII of the Periodic Table in an amount of 0.5–20% by weight, in terms of an oxide.

2. A catalyst composition according to claim 1, wherein said zeolite is selected from the group consisting of faujasite X zeolite, faujasite Y zeolite, chabasite zeolite, mordenite zeolite, and ZSM-series zeolite containing organic cation.

3. A catalyst composition according to claim 2, wherein said ZSM-series zeolite containing organic cation is a member selected from the group consisting of ZSM-4, ZSM-5, ZSM-8, ZSM-11, ZSM-12, ZSM-20, ZSM-21, ZSM-23, ZSM-34, ZSM-35, ZSM-38, and ZSM-43.

4. A catalyst composition according to claim 1, wherein said zeolite has an average particle size of 5.0 μm or smaller.

5. A catalyst composition according to claim 1, wherein said zeolite has an average particle size of 4.5 μm or smaller.

6. A catalyst composition according to claim 1, wherein said zeolite contains particles of which the diameter is 6 μm or smaller of 75–98% of all zeolite particles.

7. A catalyst composition according to claim 1, wherein said zeolite contains particles of which the diameter is 6 μm or smaller of 80–98% of all zeolite particles.

8. A catalyst composition according to claim 1, wherein the carrier comprises 5–30% by weight of zeolite.

9. A catalyst composition according to claim 1, wherein the carrier comprises 7–25% by weight of zeolite.

10. A catalyst composition according to claim 1, wherein said alumina-containing substance comprises alumina and one or more fire-resistant inorganic oxides selected from the group consisting of silica, magnesia, calcium oxide, zirconia, titania, boria, and hafnia.

11. A catalyst composition according to claim 1, wherein the carrier comprises 70–95% by weight of alumina or alumina-containing substance.

12. A catalyst composition according to claim 1, wherein the carrier comprises 75–93% by weight of alumina or alumina-containing substance.

13. A catalyst composition according to claim 1, wherein said alumina or alumina-containing substance has a mean pore diameter of 65–110 angstrom.

14. A catalyst composition according to claim 1, wherein said alumina or alumina-containing substance has a mean pore diameter of 70–100 angstrom.

15. A catalyst composition according to claim 1, wherein the pore volume of said alumina or alumina-containing substance having the pore diameter falling within ±10 angstrom of the mean pore diameter is 80–98% of the total pore volume.

16. A catalyst composition according to claim 1, wherein the pore volume of said alumina or alumina-containing substance having the pore diameter falling within ±10 angstrom of the mean pore diameter is 85–98% of the total pore volume.

17. A catalyst composition according to claim 1, wherein said metal belonging to Group VIB of the Periodic Table is one or more members selected from the group consisting of chromium, molybdenum, and tungsten.

18. A catalyst composition according to claim 1, wherein said metal belonging to Group VIII of the Periodic Table is one or more members selected from the group consisting of iron, cobalt, nickel, palladium, platinum, osmium, iridium, ruthenium, and rhodium.

19. A catalyst composition according to claim 1, which comprises said at least one metal belonging to Group VIB of the Periodic Table in an amount of 7–25% by weight in terms of an oxide.

20. A catalyst composition according to claim 1, which comprises said at least one metal belonging to Group VIb of the Periodic Table in an amount of 10–20% by weight in terms of an oxide.

21. A catalyst composition according to claim 1, which comprises said at least one metal belonging to Group VIII of the Periodic Table in an amount of 1–12% by weight in terms of an oxide.

22. A catalyst composition according to claim 1, which comprises said at least one metal belonging to Group VIII of the Periodic Table in an amount of 2–8% by weight in terms of an oxide.

* * * * *